US010731862B2

(12) United States Patent
Shershnyov et al.

(10) Patent No.: US 10,731,862 B2
(45) Date of Patent: Aug. 4, 2020

(54) SYSTEMS AND METHODS FOR A MULTI-FUEL PREMIXING NOZZLE WITH INTEGRAL LIQUID INJECTORS/EVAPORATORS

(71) Applicant: GENERAL ELECTRIC COMPANY, Schenectady, NY (US)

(72) Inventors: Borys Borysovych Shershnyov, Moscow (RU); Geoffrey David Myers, Greenville, SC (US); Alexey Yurievich Gerasimov, Moscow (RU); Natalya Igorevna Vyazemskaya, Moscow (RU)

(73) Assignee: General Electric Company, Schenectady, NY (US)

( * ) Notice: Subject to any disclaimer, the term of this patent is extended or adjusted under 35 U.S.C. 154(b) by 142 days.

(21) Appl. No.: 15/753,713

(22) PCT Filed: Aug. 26, 2015

(86) PCT No.: PCT/RU2015/000540
§ 371 (c)(1),
(2) Date: Feb. 20, 2018

(87) PCT Pub. No.: WO2017/034435
PCT Pub. Date: Mar. 2, 2017

(65) Prior Publication Data

US 2019/0011130 A1 Jan. 10, 2019

(51) Int. Cl.
*F23R 3/28* (2006.01)
*F23R 3/14* (2006.01)
(Continued)

(52) U.S. Cl.
CPC ..... *F23R 3/286* (2013.01); *F23C 7/004* (2013.01); *F23R 3/14* (2013.01); *F23R 3/28* (2013.01);
(Continued)

(58) Field of Classification Search
CPC .... F23R 3/286; F23R 3/14; F23R 3/36; F23R 3/283; F02C 7/22; F02C 7/222; F02C 7/2365
See application file for complete search history.

(56) References Cited

U.S. PATENT DOCUMENTS 5,085,575 A 2/1992 Keller et al.
5,295,352 A 3/1994 Beebe et al.
(Continued)

FOREIGN PATENT DOCUMENTS

EP 1 323 982 A1 7/2003
EP 2 366 952 A2 9/2011
(Continued)

OTHER PUBLICATIONS

International Search Report and Written Opinion issued in connection with corresponding PCT Application No. PCT/RU2015/000540 dated Jun. 1, 2016.
(Continued)

*Primary Examiner* — Todd E Manahan
*Assistant Examiner* — Thuyhang N Nguyen
(74) *Attorney, Agent, or Firm* — Dority & Manning, P.A.

(57) ABSTRACT

A fuel nozzle assembly for a gas turbine engine is disclosed herein. The fuel nozzle assembly may include a premixing chamber formed between an outer annular shroud and an inner annular hub, a number of swirler vanes disposed about the premixing chamber between the outer annular shroud and the inner annular hub, one or more liquid fuel injectors positioned about the swirler vanes, and a flow of liquid fuel in communication with the one or more liquid fuel injectors.

17 Claims, 5 Drawing Sheets

(51) Int. Cl.
*F23R 3/34* (2006.01)
*F23C 7/00* (2006.01)

(52) U.S. Cl.
CPC .... *F23R 3/346* (2013.01); *F23C 2900/07001* (2013.01)

(56) References Cited

U.S. PATENT DOCUMENTS 5,351,477 A 10/1994 Joshi et al.
5,408,825 A 4/1995 Foss et al.
5,511,375 A * 4/1996 Joshi ..... F01D 9/065 239/403
7,140,560 B2 11/2006 Stotts et al.
7,377,036 B2 * 5/2008 Johnson ..... F23R 3/286 29/401.1
8,418,469 B2 4/2013 Myers et al.
8,511,094 B2 * 8/2013 Rising ..... F02C 3/22 60/746
9,010,119 B2 4/2015 Myers
9,217,570 B2 12/2015 Parsania et al.
2006/0236700 A1 10/2006 Saitoh et al.
2010/0077760 A1 4/2010 Laster et al.
2016/0169110 A1 6/2016 Myers et al.

FOREIGN PATENT DOCUMENTS

EP 2 660 521 A2 11/2013
WO 2004/029515 A1 4/2004

OTHER PUBLICATIONS

International Preliminary Report on Patentability issued in connection with corresponding PCT Application No. PCT/RU2015/000540 dated Feb. 27, 2018.

* cited by examiner

SYSTEMS AND METHODS FOR A MULTI-FUEL PREMIXING NOZZLE WITH INTEGRAL LIQUID INJECTORS/EVAPORATORS

FIELD

The present disclosure relates generally to gas turbine engines and more particularly relates to systems and methods for a multi-fuel premixing nozzle with integral liquid injectors/evaporators.

BACKGROUND

The operational efficiency and the overall power output of a gas turbine engine generally increases as the temperature of the hot combustion gas stream increased. High combustion gas stream temperatures, however, may produce higher levels of nitrogen oxides (NOx). Such emissions may be subject to both federal and state regulations in the U.S. and also may be subject to similar regulations abroad. A balancing act thus exists between the benefits of operating the gas turbine engine in an efficient high temperature range while also ensuring that the output of nitrogen oxides and other types of regulated emissions remain well below mandated levels. Moreover, varying load levels, varying ambient conditions, and other types of operational parameters also may have a significant impact on overall gas turbine efficiency and emissions.

Several types of known gas turbine engine designs, such as those using Dry Low NOx ("DLN") combustors, generally premix the flow of fuel and the flow of air upstream of a reaction or a combustion zone so as to reduce NOx emissions via a number of premixing fuel nozzles. Such premixing tends to reduce peak flame temperatures and, hence, NOx emissions.

For fuel flexibility and power system availability, low emissions gas turbines are often equipped with a system to inject a liquid fuel as a secondary or a backup fuel in addition to the gas premixers. The liquid fuel injectors may be inserted through the center of the gas premixers. Because the liquid fuel may not evaporate and premix sufficiently with the air prior to combustion, large quantities of water may be injected into the combustion zone so as to reduce the flame temperatures and the resultant NOx emissions. A significant and expensive volume of water thus may be required when operating with such a liquid fuel. Moreover, water injection may lower overall gas turbine efficiency.

There is thus a desire for an improved dual fuel premixing nozzle. Such a premixing nozzle may accommodate a secondary fuel such as a liquid fuel with reduced overall water consumption or without any water injection while maintaining gas turbine thermal efficiency and power generation.

BRIEF DESCRIPTION

Some or all of the above needs and/or problems may be addressed by certain embodiments of the present disclosure. According to an embodiment, there is disclosed a fuel nozzle assembly for a gas turbine engine. The fuel nozzle assembly may include a premixing chamber formed between an outer annular shroud and an inner annular hub, a number of swirler vanes disposed about the premixing chamber between the outer annular shroud and the inner annular hub, one or more liquid fuel injectors positioned about the swirler vanes, and a flow of liquid fuel in communication with the one or more liquid fuel injectors.

In another embodiment, a gas turbine engine is disclosed. The gas turbine engine may include a compressor, a combustor in communication with the compressor, and a turbine in communication with the combustor. The combustor may include a fuel nozzle assembly. The fuel nozzle assembly may include a premixing chamber formed between an outer annular shroud and an inner annular hub, a number of swirler vanes disposed about the premixing chamber between the outer annular shroud and the inner annular hub, one or more liquid fuel injectors positioned about the swirler vanes, a flow of liquid fuel in communication with the one or more liquid fuel injectors.

According to another embodiment, a fuel nozzle assembly for a gas turbine engine is disclosed. The fuel nozzle may include a premixing chamber formed between an outer annular shroud and an inner annular hub, a number of swirler vanes disposed about the premixing chamber between the outer annular shroud and the inner annular hub, one or more liquid fuel injectors positioned about a trailing edge of the swirler vanes, and a flow of liquid fuel in communication with the one or more liquid fuel injectors. The liquid fuel may include a distillate, biodiesel, ethanol, a heavy carbon gases in liquid phase, or a combination thereof. The one or more fuel injectors may inject with atomization the flow of liquid fuel into the premixing/evaporating chamber.

Other embodiments, aspects, and features of the disclosure will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale.

DETAILED DESCRIPTION

Illustrative embodiments will now be described more fully hereinafter with reference to the accompanying drawings, in which some, but not all embodiments are shown. The present disclosure may be embodied in many different forms and should not be construed as limited to the embodiments set forth herein. Like numbers refer to like elements throughout.

Figure 1:
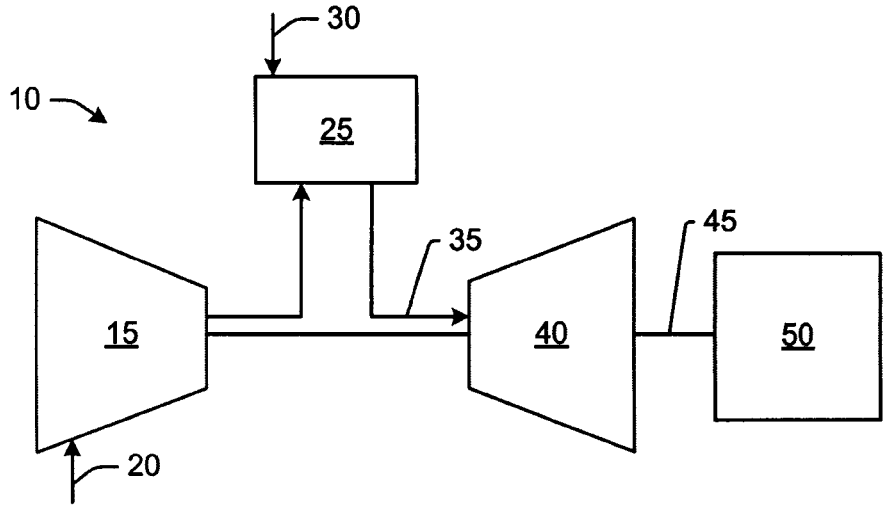
FIG. 1 schematically depicts an example gas turbine engine according to an embodiment.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of the combustors 25 arranged in a circumferential array or otherwise. The flow of combustion gases 35 is delivered in turn to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuels, various types of syngas, and/or other types of fuels and blends thereof. The gas turbine engine 10 may be any one of a number of different gas turbine engines offered by General Electric Company of Schenectady, New York, including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
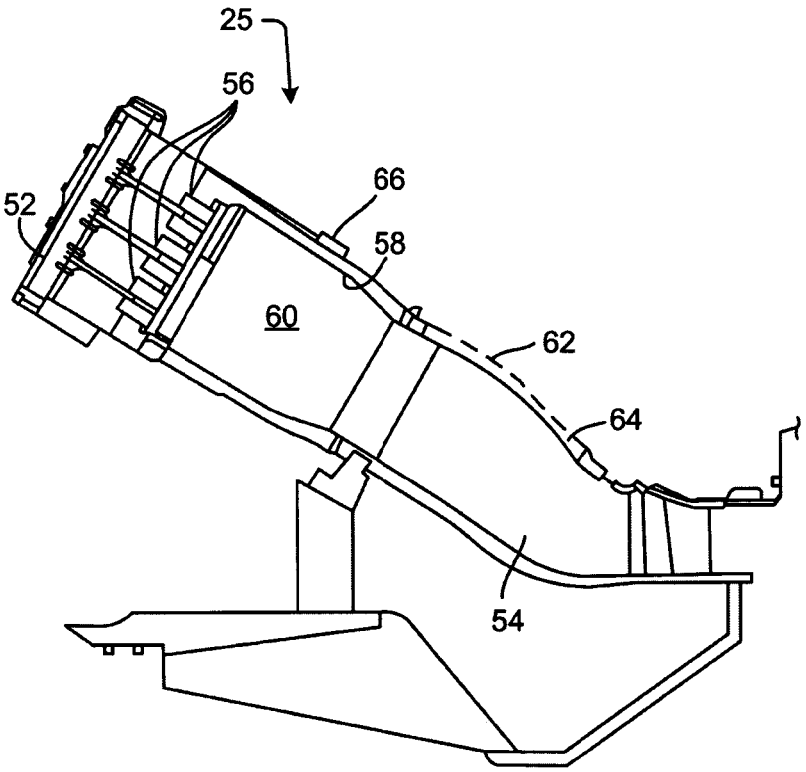
FIG. 2 schematically depicts an example cross-section of a combustor according to an embodiment.

FIG. 2 shows a schematic cross-section of an example of the combustor 25 as may be used with the gas turbine engine 10 described above and the like. The combustor 25 may extend from an end cover 52 at a head end to a transition piece 54 at an aft end about the turbine 40. A number of fuel nozzles 56 may be positioned about the end cover 52. A liner 58 may extend from the fuel nozzles 56 towards the transition piece 54 and may define a combustion zone 60 therein. The liner 58 and transition piece 54 may be surrounded by a flow sleeve 62. The liner 58, transition piece 54 and the flow sleeve 62 may define a flow path 64 there between for the flow of air 20 from the compressor 15 or otherwise. An outer casing 66 may surround the flow sleeve 62 in part. Any number of the combustors 25 may be used herein in a circumferential array and the like. As described above, the flow of air 20 and the flow of fuel 30 may be ignited in the combustor 25 to create the flow of combustion gases 35. The combustor 25 described herein is for the purpose of example only. Combustors with other types of components and other configurations also may be used herein.

Figure 3:
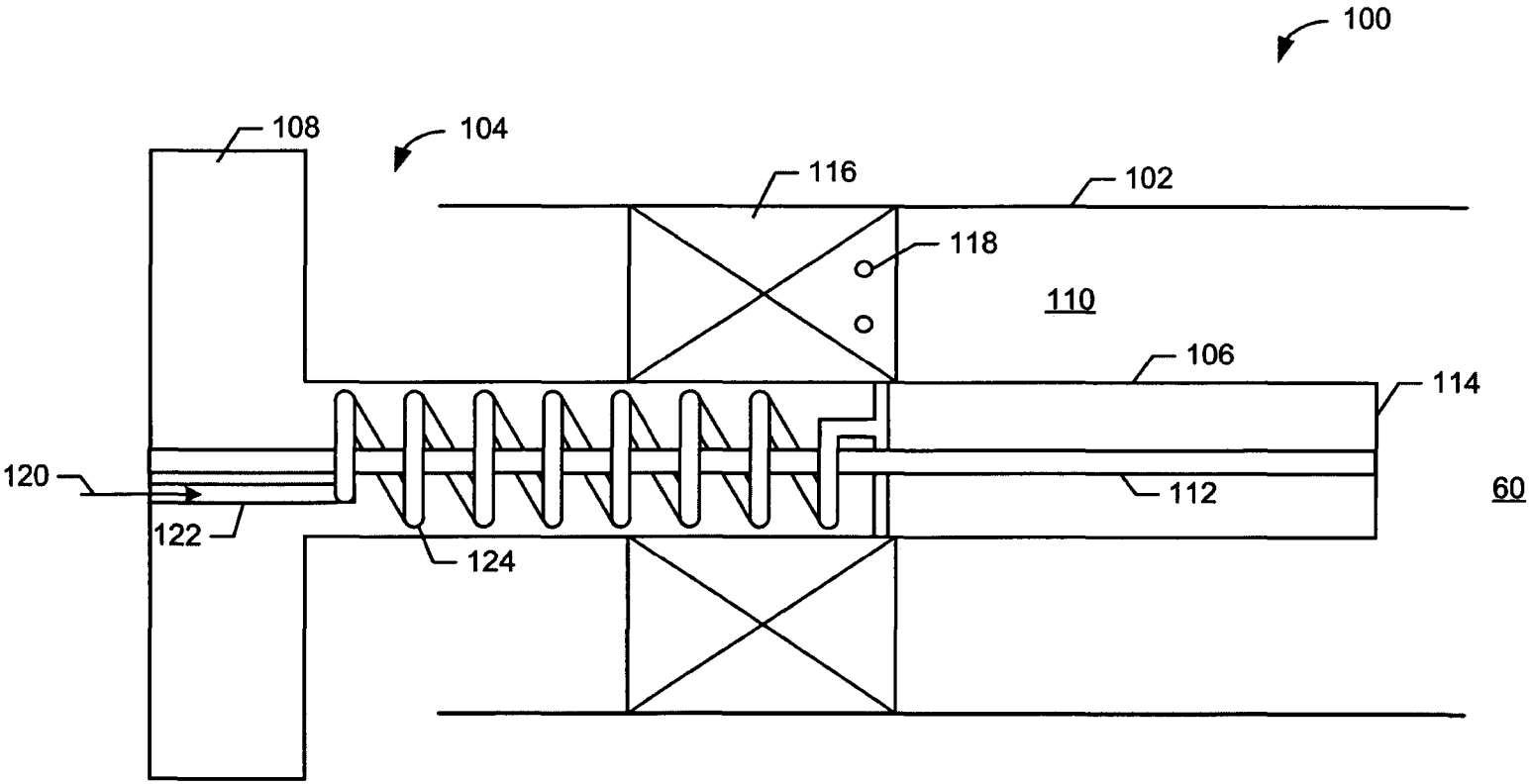
FIG. 3 schematically depicts an example cross-section of a premixing fuel nozzle according to an embodiment.

FIG. 3 schematically depicts an example cross-section of a premixing fuel nozzle 100 as may be described herein. The premixing fuel nozzle 100 may be used with the combustor 25 or the like. The combustor 25 may include any number of the premixing fuel nozzles 100 in any configuration.

Generally described, the premixing fuel nozzle 100 may include an outer annular shroud 102. The outer annular shroud 102 may extend from an air inlet 104 on an upstream end thereof and may end about the combustion zone 60 at a downstream end thereof. The outer annular shroud 102 may surround an inner annular wall or a hub 106. The hub 106 may extend from a fuel nozzle flange 108 at the upstream end thereof and may end upstream of the end of the outer annular shroud 102. The outer annular shroud 102 and the hub 106 may define a premixing chamber 110 there between. The premixing chamber 110 may be in communication with the flow of air 20 from the compressor 15 or elsewhere.

The premixing fuel nozzle 100 also may include a number of tubes defining discrete passages for the flow of different types of fluids. For example, the premixing fuel nozzle 100 may include a number of tubes that define a number of fuel circuits. The tubes may have any suitable size, shape, or configuration. For example, a pilot fuel passage 112 may extend through the middle of the premixing fuel nozzle 100 from the fuel nozzle flange 108 to a pilot tip 114. The pilot tip 114 may comprise a direct injection pilot nozzle. That is, the pilot fuel passage 112 and pilot tip 114 may be used for flows of liquid or gas fuels or other types of fluids for direct injection into the combustion zone 60. For example, the pilot fuel passage 112 may include a flow of water and/or other types of fluids could be used herein. Other passages also may be used herein. Other components and other configurations may be used herein.

A number of swirler vanes 116 may extend from the hub 106 to or about the outer annular shroud 102. The swirler vanes 116 may have any suitable size, shape, or configuration. As discussed in greater detail below, a number of fuel injectors 118 may be positioned about the swirler vanes 116. For example, each swirler vane 116 may include one or more fuel injectors 118. In some instances, each swirler vane 116 may include 10, 20, 30, 40, 50, or more fuel injectors 118. Any number of fuel injectors 118 may be used herein. In some instances, the fuel injectors 118 may be arranged in a circumferential array at the same radial location about the swirler vanes 116. In other instances, the fuel injectors 118 may be arranged in a number of circumferential arrays about the swirler vanes 116. The fuel injectors 118 may be disposed at any location and in any configuration or pattern about the swirler vanes 116.

The fuel injectors 118 may act as liquid fuel injectors for injecting and atomizing a liquid fuel into the premixing chamber 110. In some instances, the fuel injectors 118 may be disposed about a radial midpoint of each swirler vane 116. In other instances, the fuel injectors 118 may be disposed about a trailing edge of the swirler vanes 116. The fuel injectors 118 may be disposed at any location(s) on the swirler vanes 116. The fuel injectors 118 may be in communication with a flow of liquid fuel 120. For example, the premixing fuel nozzle 100 may include a liquid fuel system 122. The liquid fuel system 122 may provide the flow of liquid fuel 120, which may be a liquid fuel (such as a distillate, biodiesel, ethanol, or the like) or a liquid gas (such as heavy carbon gases, etc.). The liquid fuel system 122 may include a liquid fuel passage 124, which may provide the liquid fuel 120 to the fuel injectors 118. For example, the liquid fuel passage 124 may extend from the gas fuel nozzle flange 108 to the fuel injectors 118 about the swirler vanes 116. In some instances, the liquid fuel passage 124 may form a coil about a portion of the pilot fuel passage 112. The swirler vanes 116 and the fuel injectors 118 thus may provide liquid fuel/air mixing. The flow of air 20 and the flow of liquid fuel 120 may begin to mix within the premixing chamber 110 at or downstream of the swirler vanes 116 and flow into the combustion zone 60. Other components and other configurations may be used herein.

Figure 5:
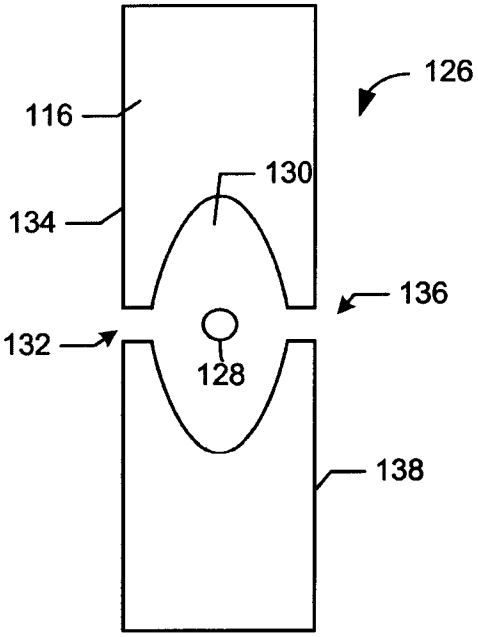
FIG. 5 schematically depicts an example cross-section of a fuel injector according to an embodiment.
Figure 4:
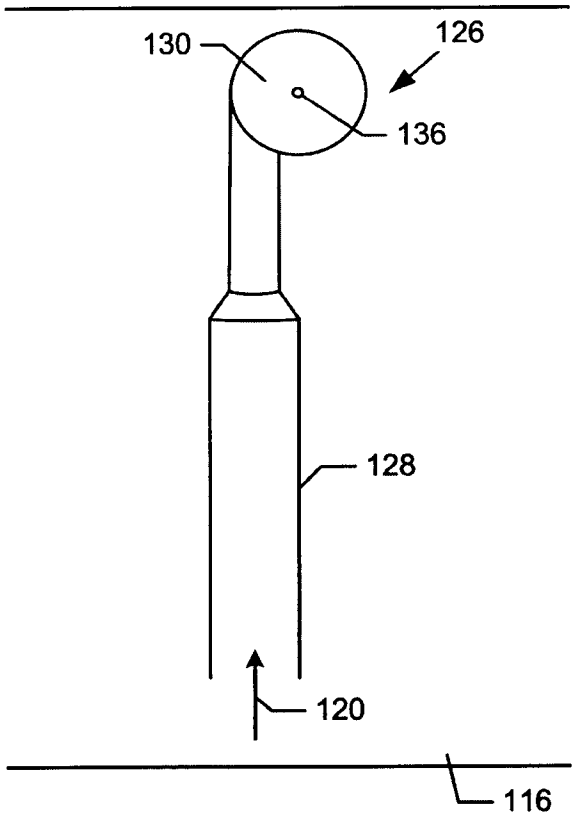
FIG. 4 schematically depicts an example cross-section of a fuel injector according to an embodiment.

FIG. 4 schematically depicts an example cross-section of one of the swirler vanes 116 along an axial plane of the premixing fuel nozzle 100, and FIG. 5 schematically depicts an example cross-section of one of the swirler vanes 116 along a radial plane of the premixing fuel nozzle 100. As depicted in FIGS. 4 and 5, the fuel injectors 118 may comprise double sided atomizers 126. The double sided atomizers 126 may include a liquid fuel conduit 128 in fluid communication with the liquid fuel passage 124. The liquid fuel conduit 128 may exit into a cavity 130 disposed within the swirler vane 116. In this manner, the liquid fuel 120 may exit into the cavity 130. The cavity 130 may include a first orifice 132 on a first side 134 of the swirler vane 116 and a second orifice 136 on a second side 138 of the swirler vane 116. The first orifice 132 and the second orifice 136 may inject and atomize the liquid fuel 120 on both sides of the swirler vane 116.

Figure 6:
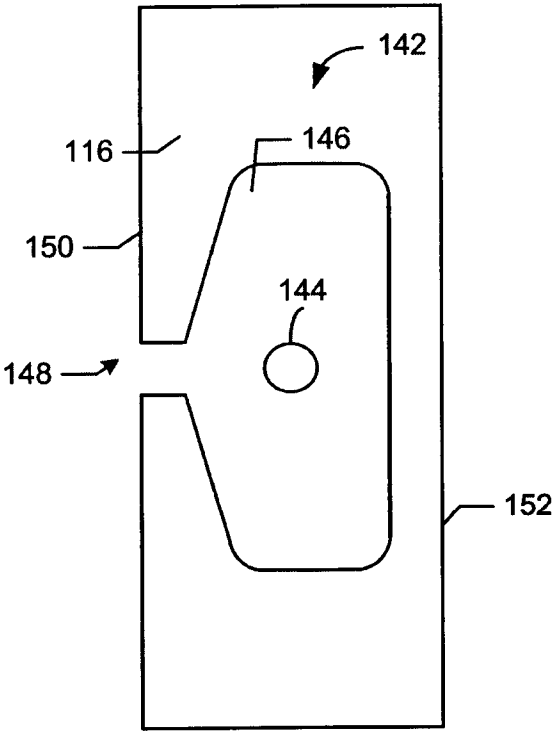
FIG. 6 schematically depicts an example cross-section of a fuel injector according to an embodiment.

FIG. 6 schematically depicts an example cross-section of one of the swirler vanes 116 along a radial plane of the premixing fuel nozzle 100. As depicted in FIG. 6, the fuel injectors 118 may comprise single sided atomizers 142. The single sided atomizers 142 may be similar to the double sided atomizers 126, except that the single sided atomizers 142 may include only one orifice on one side of the swirler vane 116.

For example, the single sided atomizer 142 may include a liquid fuel conduit 144 in fluid communication with the liquid fuel passage 124. The liquid fuel conduit 144 may exit into a cavity 146 disposed within the swirler vane 116. The cavity 146 may include an orifice 148 on a first side 150 of the swirler vane 116. A second side 152 of the swirler vane 116 may not include an orifice. The orifice 148 may inject and atomize the liquid fuel 120 on one side of the swirler vane 116.

Figure 7:
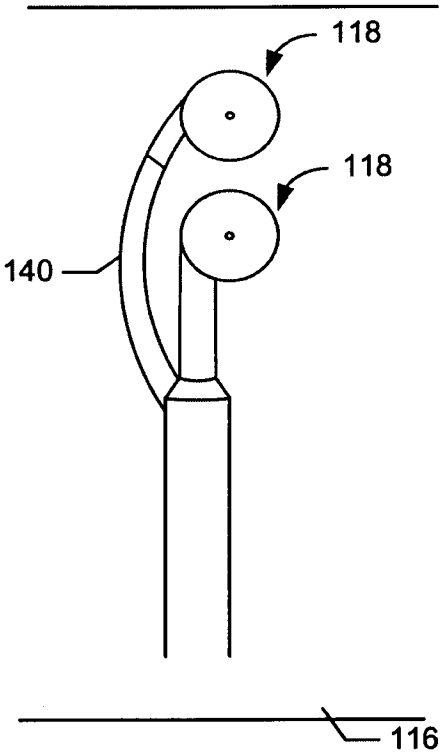
FIG. 7 schematically depicts an example cross-section of one or more fuel injectors according to an embodiment.

FIG. 7 schematically depicts an example cross-section of one of the swirler vanes 116 along an axial plane of the premixing fuel nozzle 100. As depicted in FIG. 7, the fuel injectors 118 may include a cluster of double sided atomizers 126 and/or single sided atomizers 142. For example, the double sided atomizers 126 and/or the single sided atomizers 142 may be in communication with one another by way of a connecting conduit 140. In this manner, a number of double sided atomizers 126 and/or single sided atomizers 142 may be interconnected by way of a number of connecting conduits 140.

Figure 8:
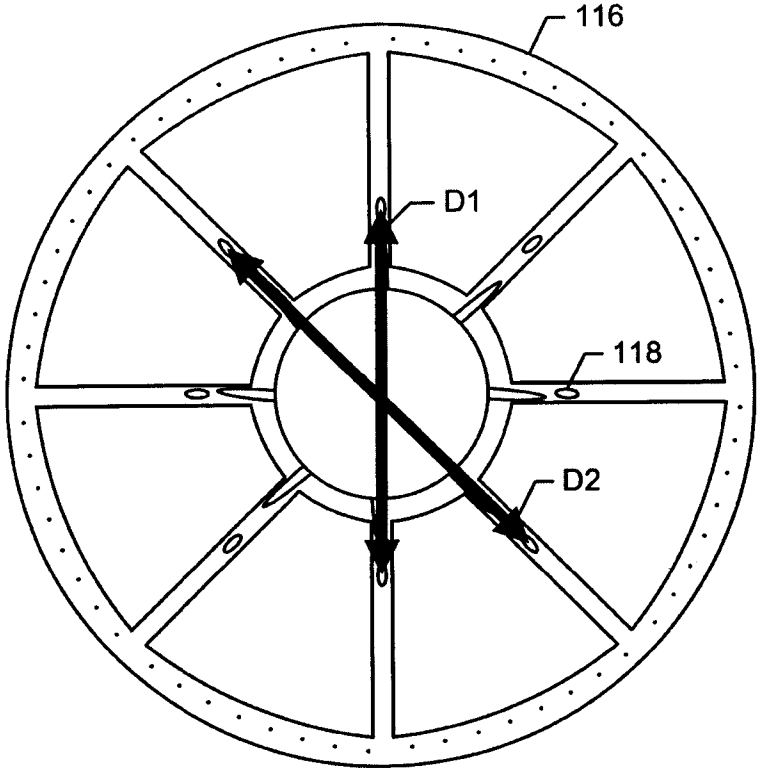
FIG. 8 schematically depicts an example cross-section of a swirler according to an embodiment.

FIG. 8 schematically depicts an example cross-section of the swirler vanes 116 along a radial plane of the premixing fuel nozzle 100. FIG. 8 depicts the arrangement of the fuel injectors 118 about the swirler vanes 116. In some instances, the fuel injectors 118 may be arranged in a single circumferential array at the same radial location about the swirler vanes 116. For example, fuel injectors 118 may be located at D1 or D2. In other instances, the fuel injectors 118 may be arranged in a number of circumferential arrays about the swirler vanes 116. For example, fuel injectors 118 may be located at D1 or D2. The fuel injectors 118 may be disposed at any location and in any configuration or pattern about the swirler vanes 116. The fuel injectors may comprise single sided or double sided atomizers.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A fuel nozzle assembly for a gas turbine engine, comprising:

a premixing chamber formed between an outer annular shroud and an inner annular hub;

a pilot fuel passage disposed within the inner annular hub;

a liquid fuel passage positioned between the inner annular huh and the pilot fuel passage, wherein the liquid fuel passage forms a coil about a portion of the pilot fuel passage;

a plurality of swirler vanes disposed about the premixing chamber, wherein each swirler vane of the plurality of swirler vanes extends directly from the inner annular hub to the outer annular shroud;

a plurality of liquid fuel injectors positioned about the plurality of swirler vanes; and a flow of liquid fuel from the llquid fuel passage in communication with the plurality of liquid fuel injectors;

wherein each of the plurality of liquid fuel injectors comprises a connecting conduit, and a cavity, the cavity having a cross-sectional area, larger than a cross-sectional area of the connecting conduit, the connecting conduit coupled to the liquid fuel passage and configured to inject the flow of liquid fuel into the cavity disposed within the plurality of swirler vanes, and the cavity includes one or more orifices configured to inject and atomize the flow of liquid fuel into the premixing chamber.

2. The fuel nozzle assembly of claim 1, wherein the plurality of liquid fuel injectors comprise double sided atomizers.

3. The fuel nozzle assembly of claim 1, wherein the plurality of liquid fuel injectors comprise single sided atomizers.

4. The fuel nozzle assembly of claim 1, wherein the plurality of liquid fuel injectors comprise a combination of double sided and single sided atomizers.

5. The fuel nozzle assembly of claim 1, wherein the plurality of liquid fuel injectors comprise a cluster of liquid fuel atomizers.

6. The fuel nozzle assembly of claim 1, wherein the plurality of liquid fuel injectors are arranged in one or more circumferential arrays at one or more radial locations.

7. The fuel nozzle assembly of claim 1, wherein the plurality of liquid fuel injectors are disposed about a trailing edge of the plurality of swirler vanes.

8. A gas turbine engine, comprising:

a compressor;

a combustor in communication with the compressor, the combustor including a fuel nozzle assembly, comprising:

a premixing chamber formed between an outer annular shroud and an inner annular hub;

a liquid fuel passage positioned within the inner annular hub, wherein the liquid fuel passage forms a coil about a longitudinal axis of the fuel nozzle;

a plurality of swirled; vanes disposed about the premixing chamber, wherein each swirler vane of the plurality of swirler vanes extends directly from the inner annular huh to the outer annular shroud;

a plurality of liquid fuel injectors positioned about the plurality of swirler vanes; and a flow of liquid fuel in communication with the plurality of liquid fuel injectors;

wherein each of the plurality of liquid fuel injectors comprises a connecting conduit and a cavity, the cavity having a cross-sectional area larger than a cross-sectional area of the connecting conduit, the connecting conduit coupled to the liquid fuel passage and configured tai inject the flow of liquid fuel into the cavity disposed within the plurality of swirler vanes, and the cavity includes one or more orifices configured to inject and atomize the flow of liquid fuel into the premixing chamber; and a turbine in communication with the combustor.

9. The fuel nozzle assembly of claim 8, wherein the plurality of liquid fuel injectors comprise double sided atomizers.

10. The fuel nozzle assembly of claim 8, wherein the plurality of liquid fuel injectors comprise single sided atomizers.

11. The fuel nozzle assembly of claim 8, wherein the one or more plurality of liquid fuel injectors comprise a combination of double sided and single sided atomizers.

12. The fuel nozzle assembly of claim 8, wherein the plurality of liquid fuel injectors comprise a cluster of liquid fuel atomizers.

13. The fuel nozzle assembly of claim 8, wherein the plurality of liquid fuel injectors are arranged in one Or more circumferential arrays at one or more radial locations.

14. The fuel nozzle assembly of claim 8, wherein the one or more plurality of liquid fuel injectors are disposed about a trailing edge of the plurality of swirler vanes.

15. A fuel nozzle assembly for a gas turbine engine, comprising:

a premixing chamber formed between an outer annular shroud and an inner annular hub;

a plurality of swirler vanes disposed about the premixing chamber, wherein each swirler vane of the plurality of swirler vanes extends directly from the inner annular hub to the outer annular shroud;

a plurality of liquid fuel injectors positioned about a trailing edge of the plurality of swirler vanes; and a flow of liquid fuel in communication with the plurality of liquid fuel injectors, wherein the flow of liquid fuel comprises a distillate, biodiesel, ethanol, a heavy carbon gases in liquid phase, or a combination thereof, and wherein each of the plurality of liquid fuel injectors comprises a connecting conduit and a cavity, the cavity having a cross-sectional area larger than a cross-sectional area of the connecting, conduit, the connecting conduit coupled to the liquid fuel passage and configured to inject the flow of liquid fuel into the cavity disposed within the plurality of swirler vanes, and the cavity includes one more orifices configured to inject and atomize the flow of liquid fuel into the premixing chamber.

16. The fuel nozzle assembly of claim 15, wherein the plurality of liquid fuel injectors comprise double sided atomizers, single sided atomizers, or a combination thereof.

17. The fuel nozzle assembly of claim 15, wherein the plurality of liquid fuel injectors are arranged in one or more circumferential arrays at one or more radial locations.

* * * * *